US008410692B2

(12) United States Patent
Dohn et al.

(10) Patent No.: US 8,410,692 B2
(45) Date of Patent: Apr. 2, 2013

(54) LAMP HAVING A VARIABLE SUBSTRATE AS A BASE FOR A LIGHT SOURCE

(75) Inventors: Alexander Dohn, Memmelsdorg (DE); Karl Degelmann, Marktredwitz (DE); Christian Schnagl, Höchstädt (DE); Armin Veitl, Renningen (DE)

(73) Assignee: CeramTec GmbH, Plochingen (DE)

( * ) Notice: Subject to any disclaimer, the term of this patent is extended or adjusted under 35 U.S.C. 154(b) by 0 days.

(21) Appl. No.: 13/496,906

(22) PCT Filed: Sep. 30, 2010

(86) PCT No.: PCT/EP2010/005957

§ 371 (c)(1),
(2), (4) Date: Jun. 21, 2012

(87) PCT Pub. No.: WO2011/038909

PCT Pub. Date: Apr. 7, 2011

(65) Prior Publication Data

US 2012/0262059 A1 Oct. 18, 2012

(30) Foreign Application Priority Data

Sep. 30, 2009 (DE) ..... 10 2009 045 162

(51) Int. Cl.
*H01J 11/00* (2006.01)
*H01J 17/00* (2006.01)
*H01J 17/16* (2012.01)

(52) U.S. Cl. ..... 313/567; 313/634; 313/568; 313/573

(58) Field of Classification Search ..... None
See application file for complete search history.

(56) References Cited

U.S. PATENT DOCUMENTS

| | | | | |
|---|---|---|---|---|
| 5,272,408 | A * | 12/1993 | Levin et al. | 313/113 |
| 5,367,219 | A | 11/1994 | Friederichs | |
| 6,194,352 | B1 * | 2/2001 | Riley et al. | 505/431 |
| 7,195,376 | B2 | 3/2007 | Van De Poel | |
| 2004/0264196 | A1 * | 12/2004 | Shu | 362/294 |
| 2006/0284195 | A1 | 12/2006 | Nagai | |
| 2007/0159420 | A1 | 7/2007 | Chen | |
| 2007/0230188 | A1 | 10/2007 | Lin | |
| 2007/0242465 | A1 | 10/2007 | Nittke | |
| 2008/0149945 | A1 | 6/2008 | Nagai | |
| 2010/0078657 | A1 | 4/2010 | Nagai | |
| 2011/0112749 | A1 * | 5/2011 | Harumoto et al. | 701/123 |

FOREIGN PATENT DOCUMENTS

| | | | |
|---|---|---|---|
| DE | 195 39 808 | A1 | 4/1997 |
| DE | 195 39 809 | A1 | 4/1997 |
| DE | 296 20 098 | U1 | 3/1998 |
| DE | 692 23 391 | T2 | 8/1998 |
| DE | 691 30 738 | T2 | 9/1999 |
| DE | 692 29 592 | T2 | 2/2000 |
| DE | 201 02 325 | U1 | 4/2001 |
| DE | 203 10 313 | U1 | 12/2003 |

(Continued)

*Primary Examiner* — Natalie Walford
(74) *Attorney, Agent, or Firm* — Fulbright & Jaworski LLP

(57) ABSTRACT

A lamp for receiving at least one light emitting diode as a light-emitting means, having a bottom part as a supporting element and for feeding the electric connecting wires to a mounting device carrying the at least one light emitting diode, and having a lamp shade. The mounting device is a separate mounting substrate having a breaking strength between 100 and 1,000 MPa and is arranged on the bottom of the device.

20 Claims, 9 Drawing Sheets

FOREIGN PATENT DOCUMENTS

| | | | |
|---|---|---|---|
| DE | 10 233 073 | B3 | 2/2004 |
| DE | 10 2004 004 651 | B3 | 12/2005 |
| DE | 20 2006 014 239 | U1 | 12/2006 |
| DE | 20 2006 022 133 | A1 | 11/2007 |
| DE | 20 2008 007 159 | U1 | 8/2008 |
| DE | 20 2008 011 023 | U1 | 10/2008 |
| WO | WO 92/17733 | A1 | 10/1992 |
| WO | WO 2010/031810 | A1 | 3/2010 |

* cited by examiner

LAMP HAVING A VARIABLE SUBSTRATE AS A BASE FOR A LIGHT SOURCE

This application is a §371 of PCT/EP2010/005957 filed Sep. 30, 2010, and claims priority from DE 10 2009 045 162.5 filed Sep. 30, 2009.

The invention relates to a lamp for accommodating at least one LED as an illuminant, having a bottom part as a supporting element and for feeding the electrical connecting wires to a mounting device supporting the at least one LED, and having a lamp shield.

BACKGROUND INFORMATION

Current ceramic lamps are usually specially designed for a particular light source (LED, fluorescent tube, incandescent filament). For this reason, the necessary heat dissipation is permanently integrated into the design. It is disadvantageous that each variant of the actual light source requires a new design of the lamp, and the manufacture is inflexible. It is difficult to exchange components of the various lamps with one another.

FIG. 2 shows such a lamp according to the prior art,

The lamp for accommodating an LED as an illuminant is composed of a bottom part 1 as the lamp base, and a supporting element for the LED and for feeding the electrical connecting wires to the LED. The mounting device for the LED is integrated into the bottom part 1, i.e., the lamp base, and is composed of a tungsten-nickel holding area 14 to which the LED is soldered. A lamp shield 3 encloses the LED. The drawback of this lamp is that adapting the lamp to different light sources having different degrees of heat generation is possible only via a new design. The lamp base is composed of a single ceramic, so that when a material is changed due to better thermal conductivity or for design reasons, the entire lamp base always acquires the color of the new ceramic, so that individual adaptations to the various color schemes of the lamp shield are not possible. In the case of AlN as a technically preferred material, the color of the lamp base is not very amenable to variation, and adaptation to a strongly colored lamp shield, for example, is difficult.

Socket lamps also of the GU10 type are described in the following documents:

DE 10233073 B3, DE 19539808 C2, DE 19539809 A1, DE 20102325 U1, DE 20310313 U1, DE 29620098 U1, DE 69130738 T2, DE 69223391 T2, DE 69229592 T2, DE 102004004651 B3, DE 102006022133 A1, DE 202006014239 U1, DE 202008007159 U1, DE 202008011023 U1, EP 1855052 A2, US 20070159420 A1.

Figure 1:
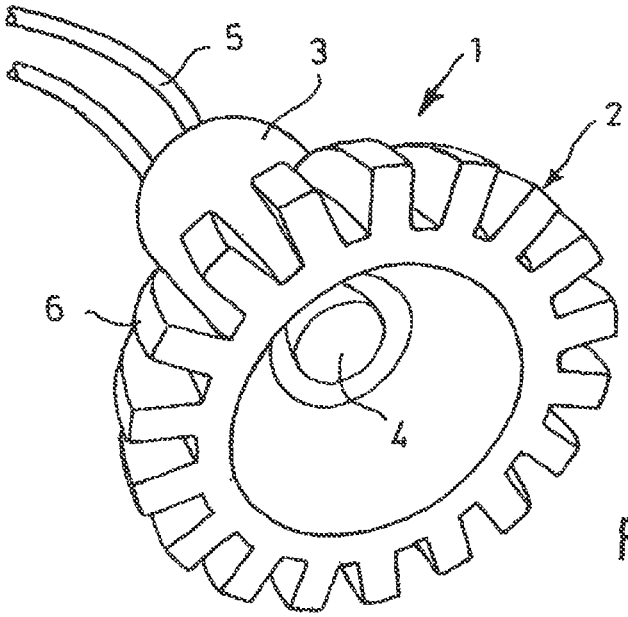
FIG. 1 shows a conventional lamp.
Figure 2:
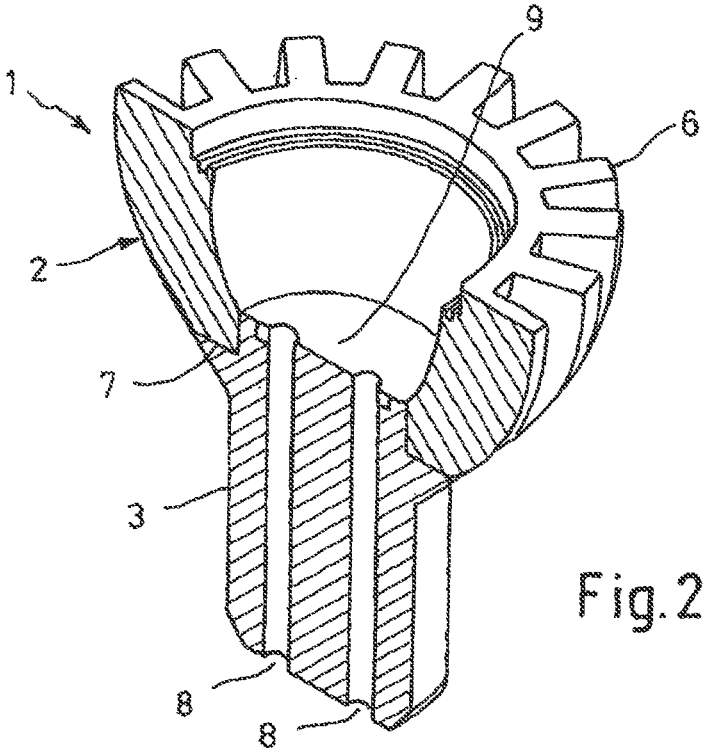
FIG. 2 shows a cross-section of a conventional lamp.

The object of the invention is to improve a lamp according to the preamble of claim 1 in such a way that the bottom part, i.e., the lamp base, may be adapted to a variety of materials or design requirements without disregarding the technical prerequisites. A further aim is that the manufacture is flexible and the components of the various lamps are interchangeable.

This object is achieved according to the invention by the features of claim 1.

As a result of the mounting device being a separate mounting substrate having a breaking strength between 100 and 1000 MPa, the material of the mounting substrate having a thermal conductivity between 10 and 250 W/m° K., and the mounting substrate being situated on the bottom part, the technical prerequisites are met or can be met, and at the same time the bottom part, i.e., the lamp base, is adaptable to a variety of materials or design requirements. Thus, the manufacture is flexible, and components of the various lamps are interchangeable. At least one metal-plated area for soldering-on of the LED is preferably applied to the mounting substrate. In one embodiment, this metal-plated area is composed of tungsten-nickel, and the metal-plated areas are made of tungsten and are chemically nickel-plated.

In one advantageous embodiment of the invention, the material of the mounting substrate has a thermal conductivity between 20 and 200 W/m° K.

The mounting substrate is preferably made of a ceramic. Ceramics may have excellent thermal conductivity and a high breaking strength. Therefore, they are preferentially suited for a mounting substrate. The surface of the ceramic substrate preferably contains sintered metal-plated areas for soldering-on of the LED/LEDs.

Leadthroughs for the electrical connecting wires are preferably situated in the mounting substrate. These connecting wires are connected to the metal-plated areas in an electrically conductive manner.

In one embodiment of the invention, the mounting substrate is a disk-shaped mounting disk. Disks are easily manufactured, and may be easily mounted on the bottom part. LEDs may be easily soldered onto mounting disks since the surfaces are flat.

The lamp preferably has a modular design composed of three ceramic parts, namely, the bottom part, the mounting substrate, and the lamp shield. On its outer surface the lamp shield has ribs extending in the longitudinal direction which enlarge the surface for cooling. Ceramics may be manufactured in a variety of colors, and therefore the lamp shield is adaptable to individual design requirements. This also applies for the bottom part as a lamp base. The mounting substrate is not visible from the outside, so that its ceramic may be adapted solely to the technical requirements. The color of the mounting substrate is not important, since it is not visible from the outside.

To conserve material and simplify manufacture, the bottom part is cylindrical, having an inner cavity and two end faces, the first end face being closed off and having passages or connecting elements for the connecting wires, and the second end face being closed off by the mounting substrate. In the present embodiment, the mounting substrate forms the closure of the bottom part, thus conserving material and at the same time providing an optimal seat of the mounting substrate.

For optimal connection, the outer upper end of the bottom part facing the mounting substrate preferably has a radially projecting shoulder on which the lamp shield rests, and which encircles the outer upper end of the bottom part. The bottom part and the lamp shield thus form a unit, and may be easily fastened together.

The mounting substrate preferably has a radial indentation at its outer periphery on which a shoulder of the lamp shield rests, and which encircles the mounting substrate. The mounting substrate is firmly anchored in this way.

The mounting substrate may also be connected to the other parts of the lamp via a screw connection, adhesive bonding, or a bayonet lock.

The mounting substrate may also be connected to the other parts of the lamp via mechanical and/or chemical means (adhesive bonding, active soldering, glass soldering, metal plating, or soldering).

The lamp shield preferably completely encloses the mounting substrate so that it is not visible from the outside. Only this concealment inside the lamp makes it possible to select the ceramic based solely on the technical requirements, and not on design preferences.

In one preferred embodiment of the invention, the mounting substrate is made of highly thermally conductive aluminum nitride (AIN). The technical requirements for breaking strength and thermal conductivity are most satisfactorily met by aluminum nitride.

In one preferred embodiment, the lamp shield is made of ruby-colored aluminum oxide with chromium oxide doping.

All or some of the ceramic parts of the lamp are preferably made of aluminum oxide, containing glass or pure, with or without additives, for example Cr2O3 as additive, having a thermal conductivity of 20 to 40 W/m° K., or aluminum nitride having a thermal conductivity of 160 to 200 W/m° K.

In another embodiment, all or some of the ceramic parts of the lamp are made of transparent or translucent ceramic, which allows the design to be adapted with attention to style.

The connecting wires are preferably guided through the cavity in the bottom part to the mounting substrate, where they are electrically connected to the mounting substrate or connected directly to the LED, The lamp is preferably a GU10 socket lamp.

The invention further relates to a mounting substrate for a lamp according to one of claims 1 through 15.

A lamp having an exchangeable mounting substrate for the light source is presented. This mounting substrate may be varied in material (different thermal conductivities) and thickness, and adapted to the quantity of heat from the light source which is to be dissipated. With the aid of a screw connection, adhesive bond, bayonet lock, or the like, the mounting substrate is connected to the parts of the rest of the lamp body by mechanical and/or chemical means (adhesive bonding, active soldering, glass soldering, metal plating, and soldering). This mounting substrate may also be made of a different material (another ceramic, metal, etc.) than the other (visible) lamp parts, and may also have a different color due to the fact that aluminum oxide, for example, can be strongly colored by doping, whereas aluminum nitride, which is attractive as a mounting substrate due to its good thermal conductivity but has a gray color, cannot. However, it is not visible inside the lamp, and only has to meet its technical purpose.

The substrate itself may be manufactured using the known shaping processes such as dry pressing or injection molding in the case of ceramic, fusion of glass onto metal in the case of an enameled metal, injection molding in the case of plastic, etc.

Figure 3:
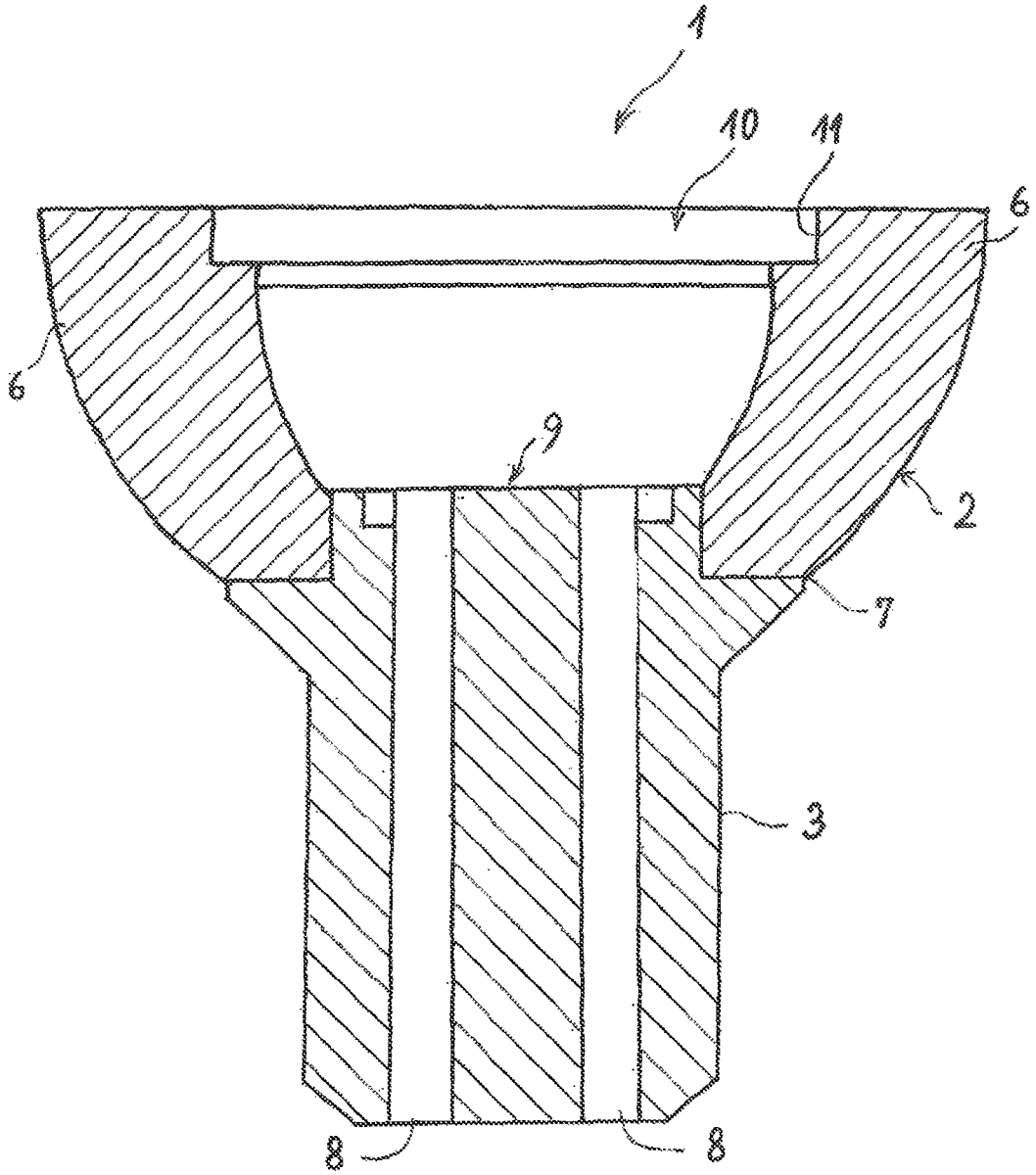
FIG. 3 shows cross-section of a conventional lamp.
Figure 4:
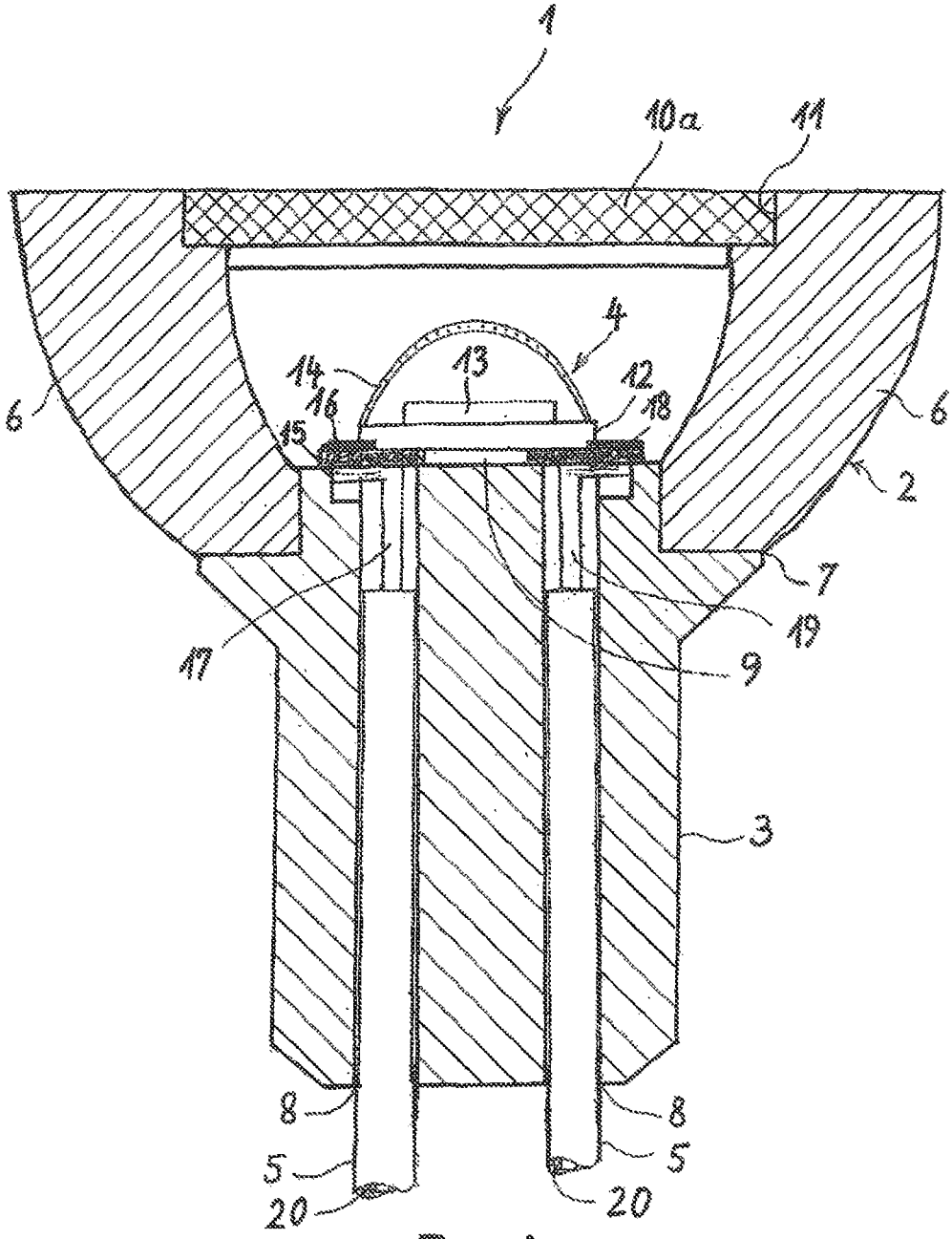
FIG. 4 shows a cross-section of a lamp according to one embodiment of the disclosure.
Figure 5:
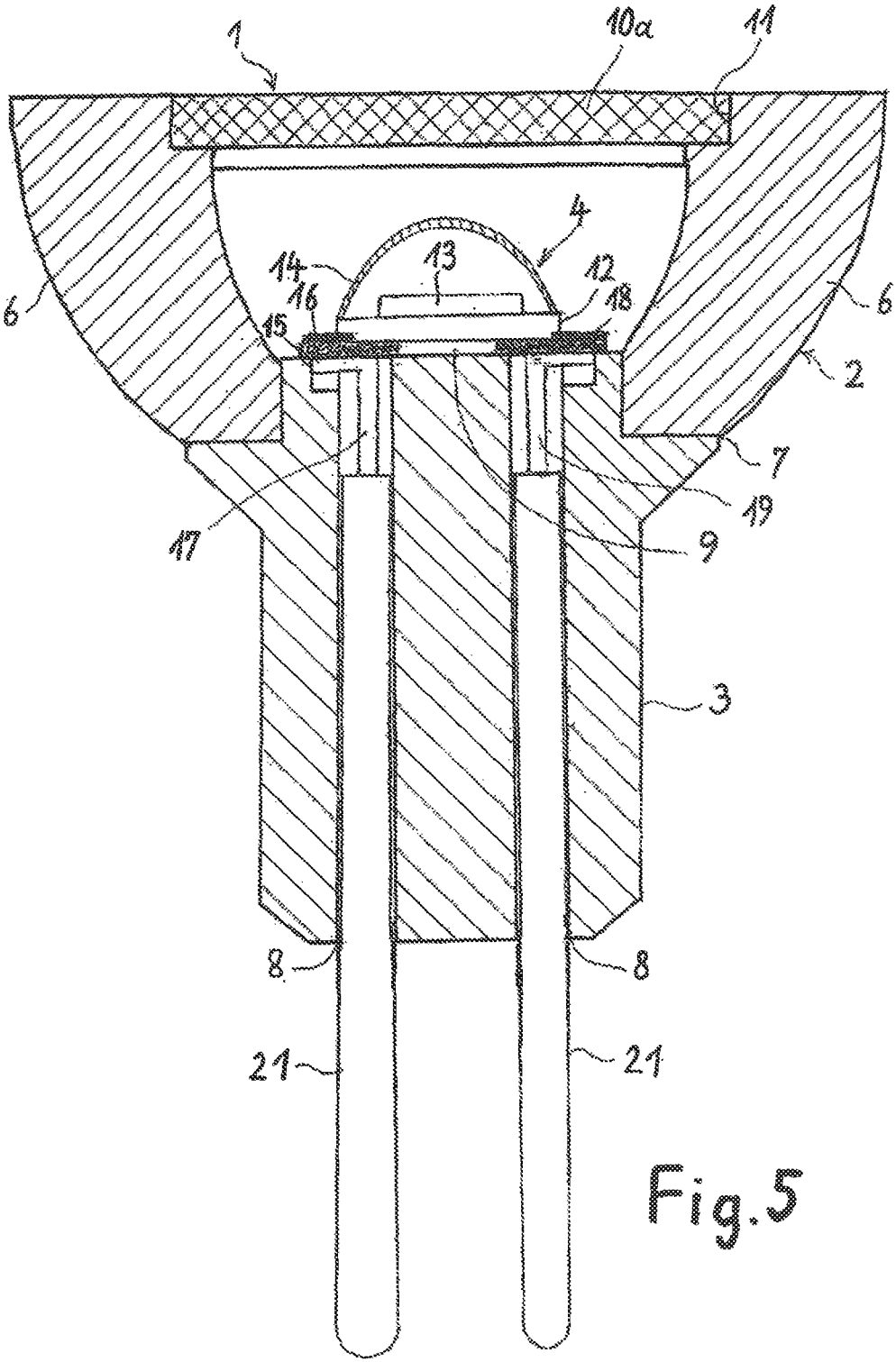
FIG. 5 shows a cross-section of a lamp according to one embodiment of the disclosure.
Figure 6:
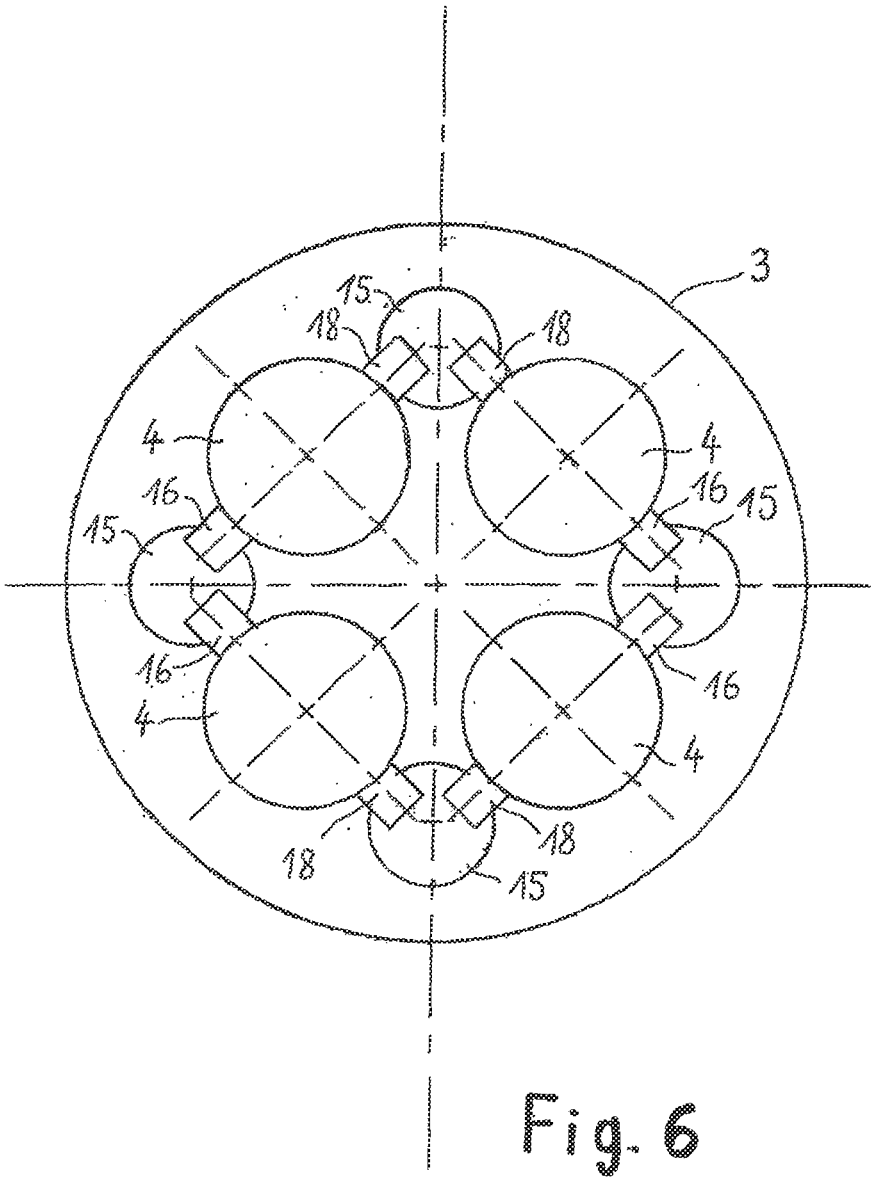
FIG. 6 shows a top-down view of a lamp according to one embodiment of the disclosure.
Figure 7:
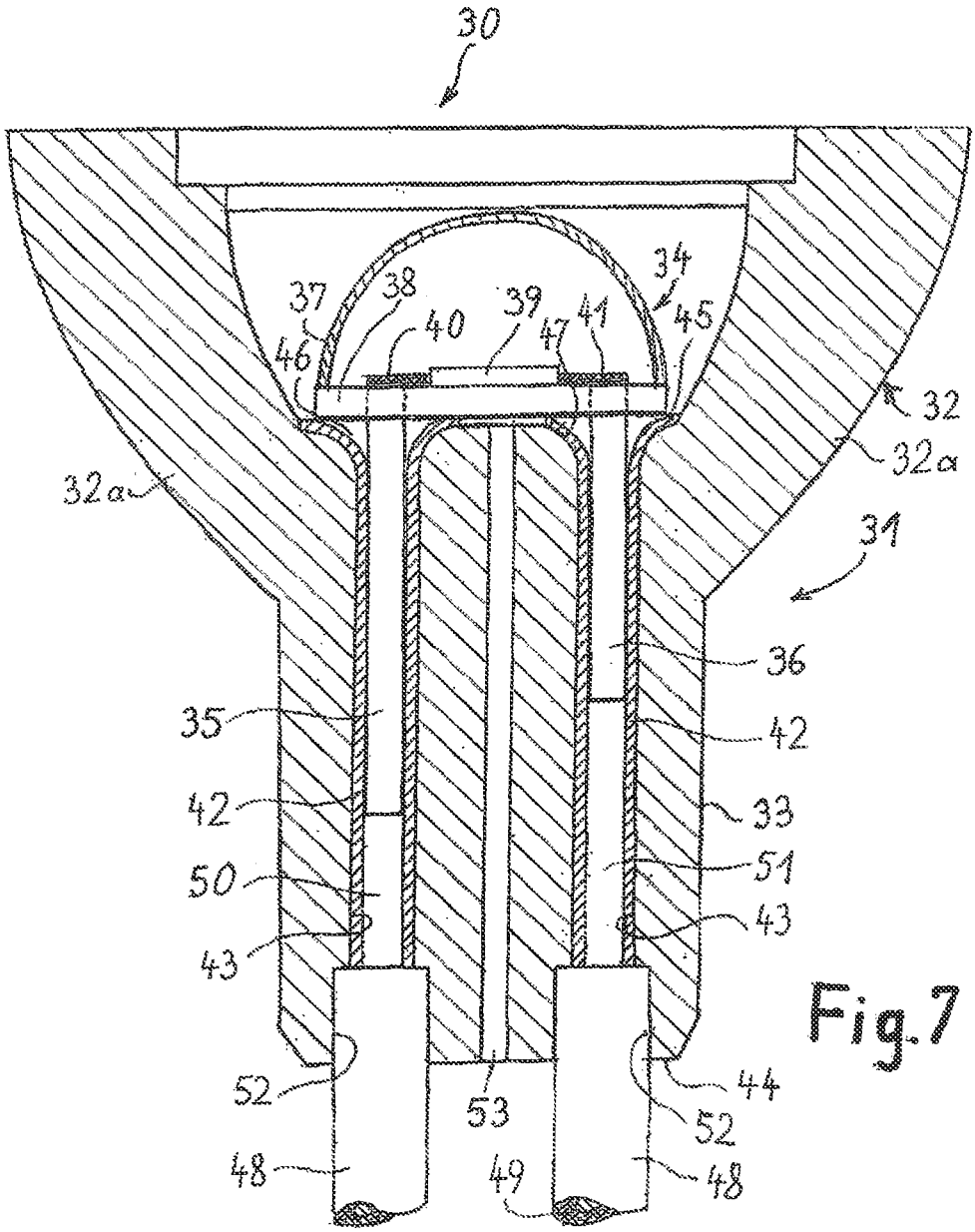
FIG. 7 shows a cross-section of a lamp according to one embodiment of the disclosure.
Figure 8:
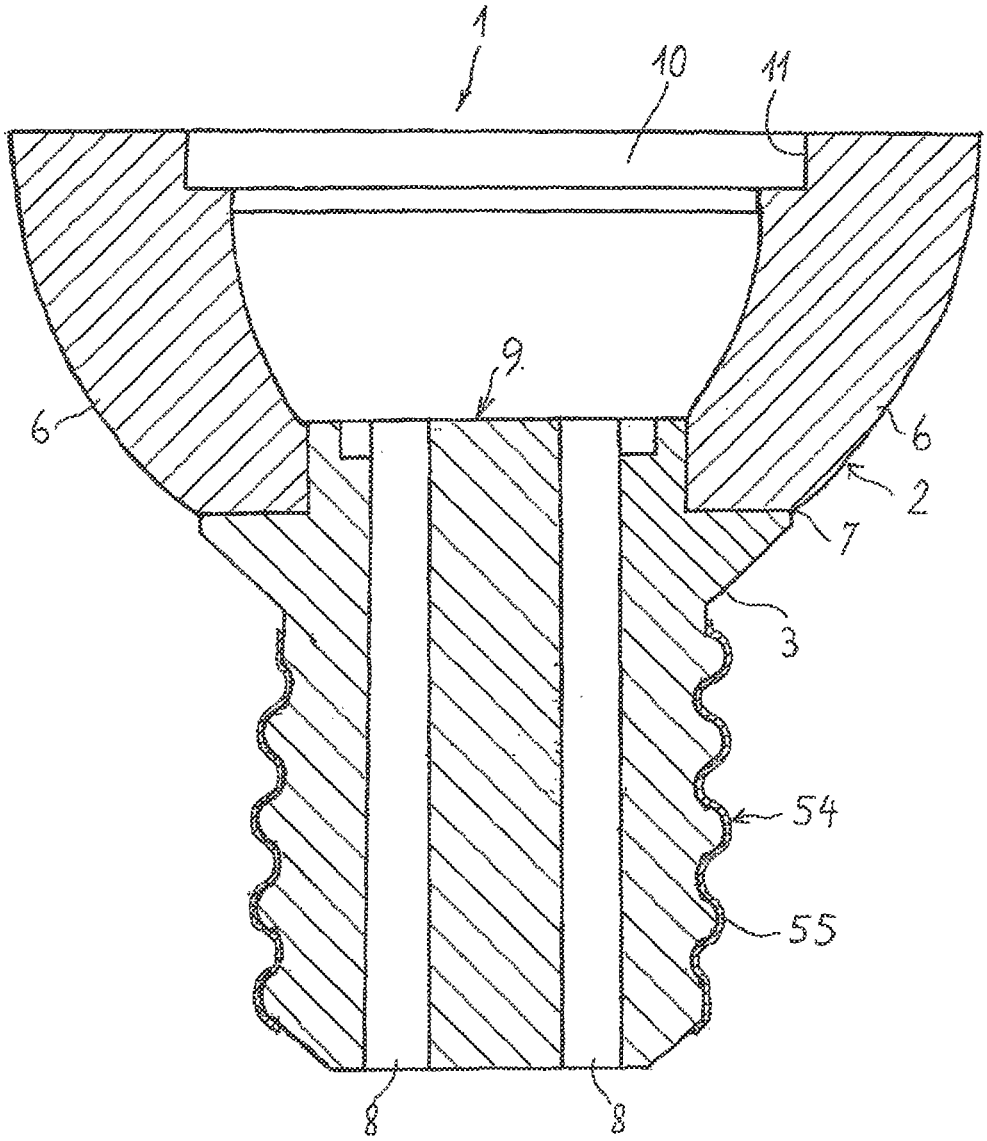
FIG. 8 shows a cross-section of a lamp according to one embodiment of the disclosure.
Figure 9:
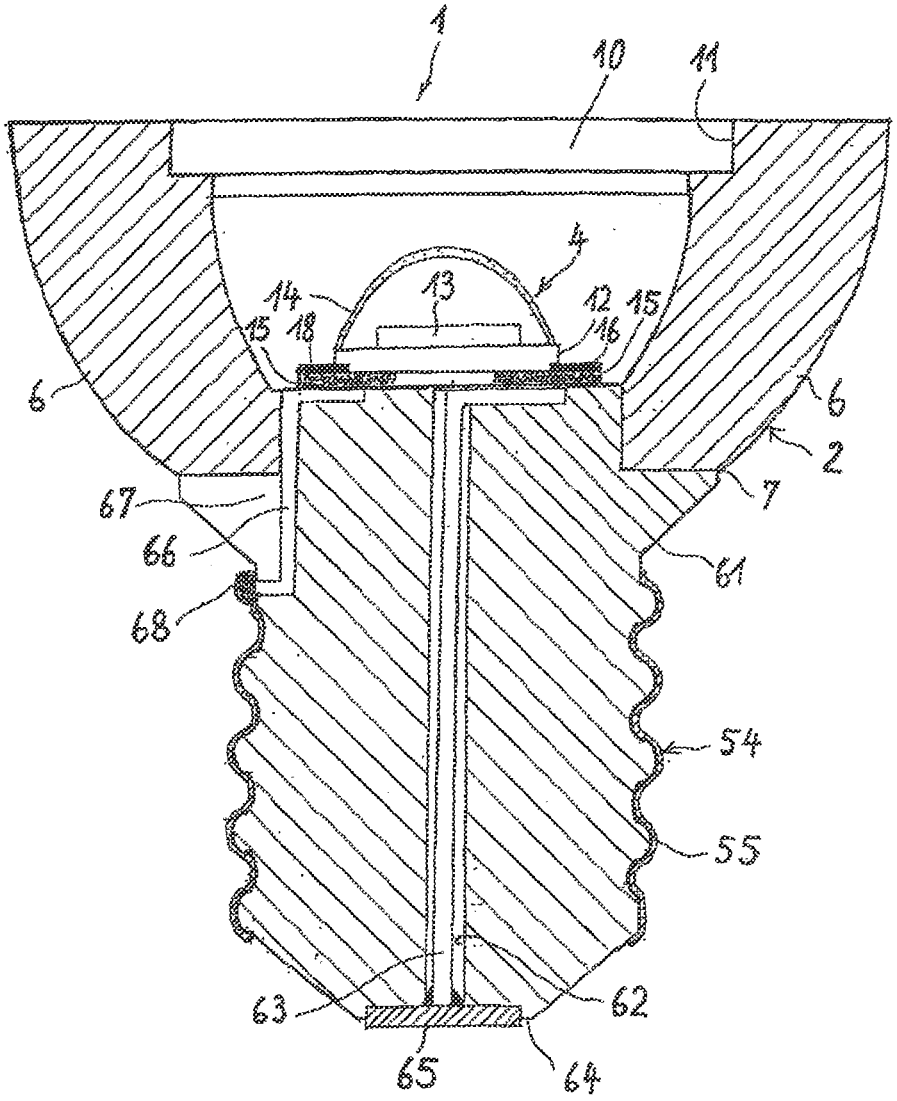
FIG. 9 shows a cross-section of a lamp according to one embodiment of the disclosure.
Figure 10:
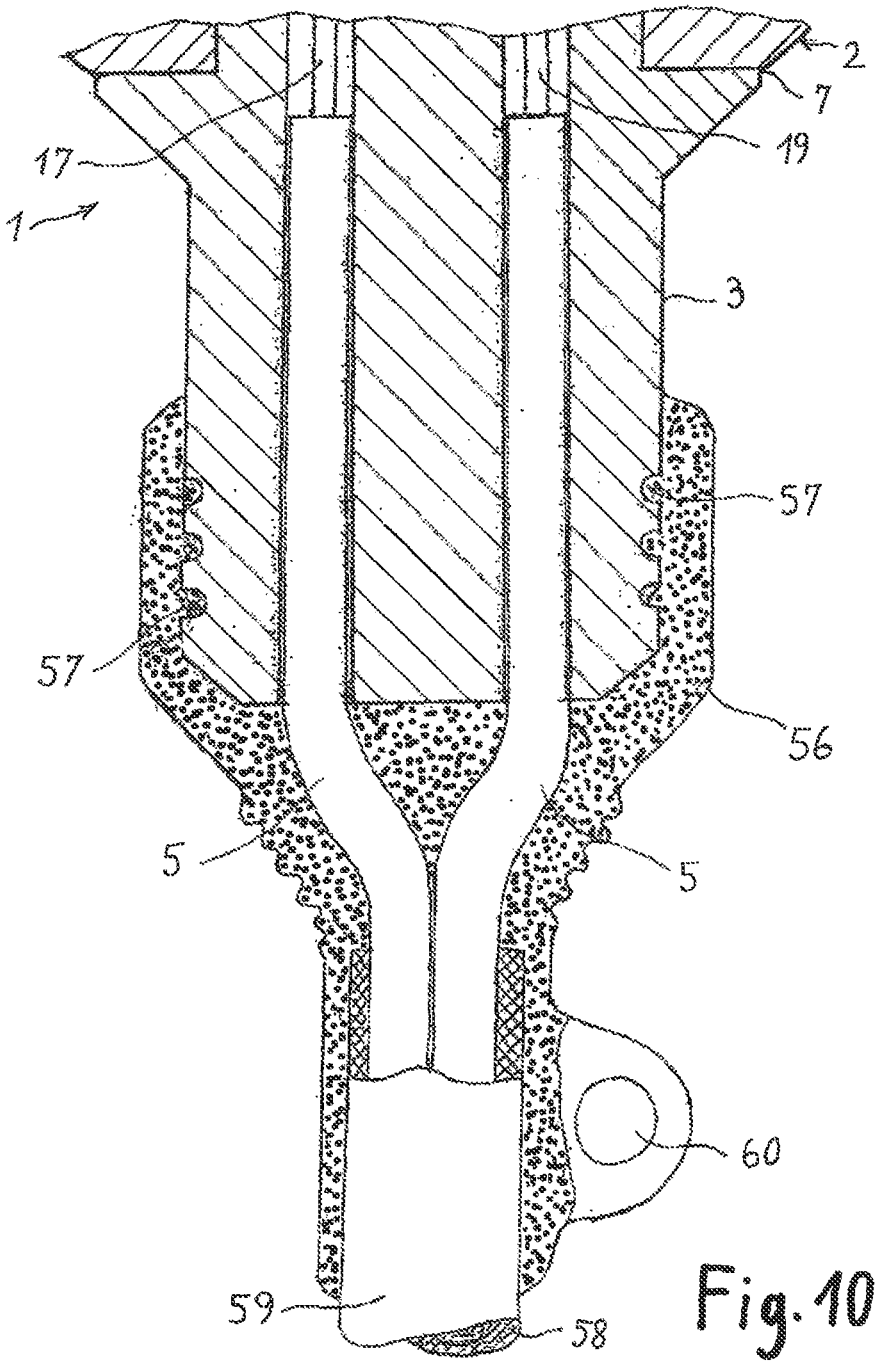
FIG. 10 shows a cross-section of a lamp according to one embodiment of the disclosure.

A lamp according to the invention is described below with reference to FIG. 1. FIG. 3 shows a ceramic substrate 4 according to the invention.

A GU10 socket lamp according to the invention is composed of a bottom part 1 having a power lead 2, a lamp shield 3, and an adhesively bondable mounting substrate 4.

In the present example, the mounting substrate 4 is a mounting disk for the LED, and is made of unattractive gray, highly thermally conductive AIN; the lamp shield 3 is made of ruby-colored aluminum oxide having chromium oxide doping. The mounting substrate 4 is not visible. The lamp body, i.e., lamp shield 3, is closed off at the upper end of the lamp shield 3 by a glass disk (not shown).

Preferably metal-plated areas 15 for soldering-on of the LED/LEDs are situated on the surface of the ceramic substrate 4. Leadthroughs 16 or plug-in elements for the electrical connecting wires are preferably situated in the mounting substrate. These connecting wires are connected to the metal-plated areas 15 in an electrically conductive manner. Any desired number of metal-plated areas 15 may be provided on the mounting substrate 4.

For better fixing, the mounting substrate 4 has a radial indentation 13 at the peripheral surface facing the metal-plated area 15.

According to the invention, in one preferred embodiment the lamp has a modular design composed of three ceramic parts, namely, a bottom part 1 having a power lead 2, a mounting substrate 4 or mounting disk, and a lamp shield 3. Electrical connecting wires, for example, (not shown in the figure) are guided through the power lead 2 into the bottom part 1, and guided inside the bottom part 1 to the mounting substrate 4. The mounting substrate 4 is made of a ceramic which preferably has high heat dissipation. A light source or multiple light sources is/are affixed to the mounting substrate 4. LEDs are preferably used as light sources. The lamp shield 3 is likewise preferably made of a ceramic, having cooling ribs 5 on its outer surface. The cooling ribs 5 extend in the longitudinal direction of the lamp shield 3.

A mounting disk is shown as the mounting substrate 4 in the present description. "Mounting substrate" is the more general term, since it is only preferred that the mounting substrate is a mounting disk. The mounting substrate may also have a design that is not disk-shaped. Otherwise, both terms describe the same subject matter.

To facilitate affixing of the lamp shield 3 to the bottom part 1, the bottom part has a shoulder 8 on its inner surface by means of which the lamp shield 3 rests on a corresponding shoulder or indentation 13 on the mounting substrate 4. The lower end of the lamp shield 3 encloses the mounting substrate 4 and the upper end 12 of the bottom part 1. The mounting substrate 4 is situated between the lamp shield 3 and the bottom part 1 in such a way that it is not visible from the outside. The upper end of the lamp shield 3 facing away from the mounting disk 4 has an internal shoulder 6 for accommodating a glass disk. The bottom part 1 is preferably cylindrical with an inner cavity 7, thus conserving material.

The lamp according to the invention is thus composed of a bottom part 1, a mounting disk 4, and a lamp shield 3 which encloses the light source, preferably an LED. The light source is affixed to the mounting substrate 4.

The lamp shield 3 which encloses the LED (light source) has three functions. It protects the LED from damage, and due to its coloring affects the color of the emitted light. However, it is primarily used as a heat sink, i.e., for dissipating the heat generated by the LED to the ambient air. To enlarge the surface, the lamp shield may have structures, for example cooling ribs 5 having any desired cross-sectional shape, distributed along its periphery. In addition, the lamp shield 3 may have any desired shape. Besides having a circular shape, it may also be polygonal, oval, or elliptical, for example.

The lamp shield 3 may be adhesively bonded or fixedly connected in some other way to the bottom part 1.

The material of the lamp must be heat-resistant. A particularly suitable material for the lamp is a ceramic material having good thermal conductivity, for example aluminum oxide, containing glass or pure, with or without additives, for example Cr2O3 having a thermal conductivity of 20 to 40 W/m° K., or aluminum nitride having a thermal conductivity of 160 to 200 W/m° K. Depending on the intended lighting effect, the material may be transparent or translucent. The breaking strength of the ceramic materials is preferably between 100 and 1000 MPa.

The base color of the ceramic material is white or glass-like. The ceramic material may also be colored using appropriate additives, known from the prior art, in the ceramic material. Various color effects may be achieved by combining LEDs which emit white or colored light with appropriate ceramic material. In addition, the shield may have a light-transmitting cover for the LED which may be clear or colored. The following color combinations are possible:

The light of the LED has a base color of white, and the ceramic material is white or glass-like.

The light of the LED has a base color of white, and the ceramic material is colored.

The light of the LED is colored, and the ceramic material is white or glass-like.

The light of the LED is colored, and the ceramic material is colored.

The light of the LED has a base color of white, the ceramic material is white or glass-like, and the cover over the LED is colorless.

The light of the LED has a base color of white, the ceramic material is white or glass-like, and the cover over the LED is colored.

The light of the LED has a base color of white, the ceramic material is colored, and the cover over the LED is colorless The light of the LED is colored, the ceramic material is white or glass-like, and the cover over the LED is colorless.

The light of the LED is colored, the ceramic material is colored, and the cover over the LED is colorless.

The light of the LED is colored, the ceramic material is colored, and the cover over he LED is colored.

The bottom part 1 may also be provided as a plug for establishing plug-in connections with corresponding plug-in sockets, or may be provided with threads for screwing into mountings, or may be provided in lamp sockets for bases fitted with connecting terminals.

The lamp shield 3 has cooling ribs 5 uniformly distributed along its periphery, so that at its opening the contour of the lamp shield 3 has the appearance of a gearwheel. The cooling ribs 5 are advantageous in particular for high-power LEDs in order to dissipate the generated heat to the ambient air. The cooling ribs may also have any other possible cross-sectional shape, for example semicircular or semi-elliptical. The shield may also be smooth for LEDs having low heat loss. The shield may likewise have different shapes, for example oval or polygonal.

The invention claimed is:

1. A lamp comprising:

a bottom part that is a supporting element and through which electrical connecting wires can be fed to a mounting device supporting a light emitting diode; and a lamp shield;

wherein the mounting device comprises a separate mounting substrate is situated on the bottom part;

and wherein the separate mounting substrate has a breaking strength between 100 and 1000 MPa;

and wherein the separate mounting substrate comprises a material having a thermal conductivity between 10 and 250 W/m° K.

2. A lamp according to claim 1, wherein the separate mounting substrate is made of a ceramic.

3. A lamp according to claim 2, further comprising sintered metal-plated areas on the separate mounting substrate for soldering-on of the light emitting diode.

4. A lamp according to claim 1, wherein the lamp is a modular design comprising the a bottom part, the separate mounting substrate, and the lamp shield.

5. A lamp according to claim 1, wherein the bottom part is cylindrical, and has an inner cavity and two end faces, wherein the first end face is closed and has passages or connecting elements for the connecting wires, and wherein the second end face is closed off by the separate mounting substrate.

6. A lamp according to claim 1, wherein an outer upper end of the bottom part facing the separate mounting substrate has a radially projecting shoulder on which the lamp shield rests, and which encircles the outer upper end of the bottom part.

7. A lamp according to claim 1, wherein the separate mounting substrate has a radial indentation at its outer periphery on which a shoulder of the lamp shield rests, and which encircles the separate mounting substrate.

8. A lamp according to claim 1, wherein the separate mounting substrate is connected to the lamp via a screw connection, adhesive bonding, or a bayonet lock.

9. A lamp according to claim 1, wherein the mounting substrate is connected to the lamp via at least one connector selected from mechanical connectors and chemical connectors.

10. A lamp according to claim 1, wherein the lamp shield completely encloses the mounting substrate so that it is not visible from the outside.

11. A lamp according to claim 1, wherein the mounting substrate is made of highly thermally conductive aluminum nitride.

12. A lamp according to claim 1, wherein the lamp shield is made of ruby-colored aluminum oxide having chromium oxide doping.

13. A lamp according to claim 1, wherein all or some of the ceramic parts of the lamp are made of aluminum oxide, containing glass or pure.

14. The lamp according to claim 13, wherein the ceramic parts of the lamp contain additives.

15. The lamp according to claim 14, wherein the additives are selected from the group consisting of $Cr_2O_3$ having a thermal conductivity of 20 to 40 W/m° K and aluminum nitride having a thermal conductivity of 160 to 200 W/m° K.

16. A lamp according to claim 1, wherein all or some of the ceramic parts of the lamp are made of transparent or translucent ceramic.

17. A lamp according to claim 1, wherein the connecting wires are guided through the cavity in the bottom part to the mounting substrate and are electrically connected to the mounting substrate.

18. A lamp according to claim 1, wherein the connecting wires are guided through the cavity in the bottom part to the mounting substrate and are electrically connected to the light emitting diode.

19. The lamp according to claim 9, wherein the connector is selected from the group consisting of an adhesive, an active soldering, a glass soldering, a metal plating and soldering.

20. A mounting substrate for a lamp according to claim 1.

US 8,410,692 B2
7 8

* * * * *